US006335708B1

(12) United States Patent
Coleman

(10) Patent No.: US 6,335,708 B1
(45) Date of Patent: Jan. 1, 2002

(54) ANTENNA TRANSFER ASSEMBLY WITH JAM PREVENTING INSERTS

(75) Inventor: William C. Coleman, Pilesgrove, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/770,796

(22) Filed: Jan. 24, 2001

(51) Int. Cl.[7] ..... H01Q 1/12

(52) U.S. Cl. ..... 343/877; 343/709

(58) Field of Search ..... 343/877, 709, 343/710, 719; 242/249

(56) References Cited

U.S. PATENT DOCUMENTS 3,789,415 A * 1/1974 Vickland ..... 343/763
3,961,589 A * 6/1976 Lombardi ..... 114/16 R
4,484,486 A * 11/1984 Staehlin ..... 74/96

* cited by examiner

*Primary Examiner*—Don Wong
*Assistant Examiner*—Hoang Nguyen
(74) *Attorney, Agent, or Firm*—Jacob Shuster

(57) ABSTRACT

A flexible antenna cable is deployed or retrieved by movement along a helical path through an enclosure passage formed between internal surfaces of an assembly within which a plurality of cable pulleys are disposed in contact with the cable for exercising drive control over cable movement. A plurality of solid inserts shaped to occupy spaces between the pulleys within the helical passage, preclude buckling of the antenna cable during deployment and thereby prevent jamming.

7 Claims, 2 Drawing Sheets

FIG. 1
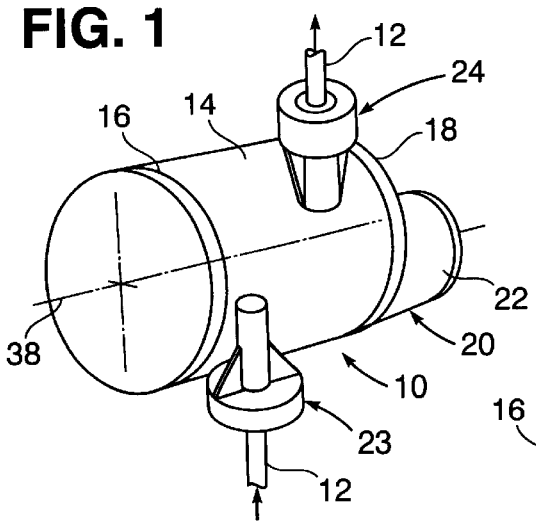
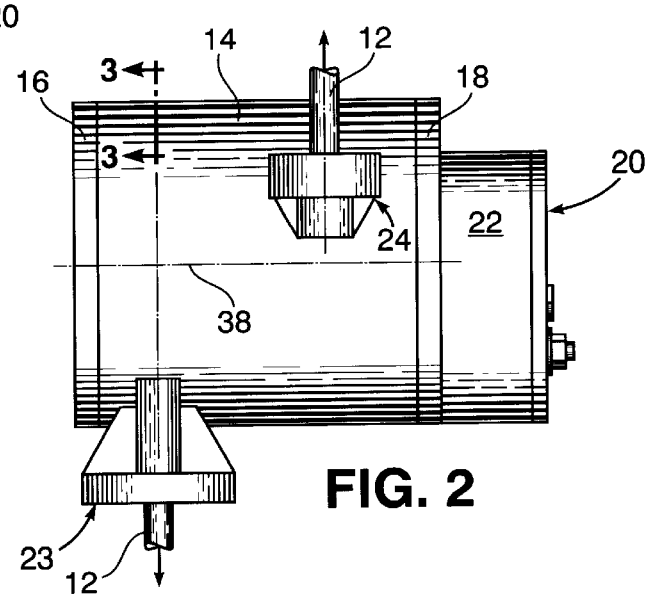
FIG. 2
FIG. 3
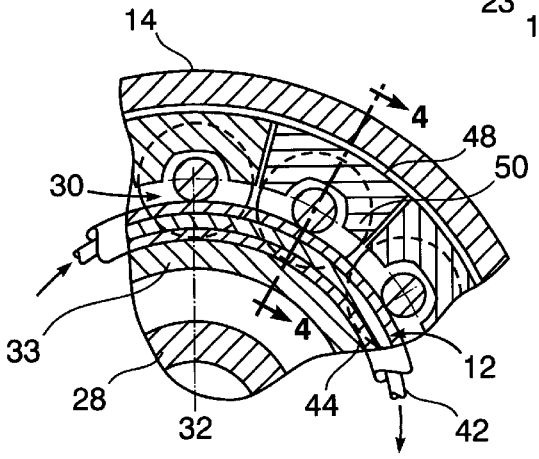
FIG. 3A
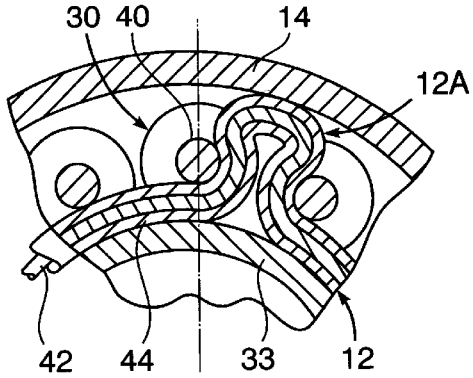

ANTENNA TRANSFER ASSEMBLY WITH JAM PREVENTING INSERTS

The present invention relates in general to the projection and retrieval of an elongated communication antenna.

BACKGROUND OF THE INVENTION

In association with the present invention, an antenna transfer assembly is provided for exposure to an underwater environment through which a buoyant antenna cable is projected against water pressure or retrieved under selective control through a powered drive mechanism. During deployment of the antenna cable through such an antenna transfer assembly, because of its flexibility forces exerted on the antenna cable when pushed out of a submarine for example against sea water pressure and under friction restraint place it under axial compression causing it to jam. Such jamming occurs because of cable buckling inside of the antenna transfer assembly, preventing further deployment or retrieval movement from being imparted to the cable. It is therefore an important object of the present invention to prevent antenna buckling causing jamming inside of an antenna transfer assembly of a type exposed to an underwater environment, without resort to costly and operationally complex solutions.

SUMMARY OF THE INVENTION

In accordance with one embodiment of the present invention, a plurality of solid inserts fill empty spaces within which an antenna may otherwise buckle, thus restraining the antenna inside of the intended helical passage formed within the antenna transfer assembly to which the antenna cable is confined while driven under selective control during deployment or retrieval. When the antenna is under axial compression, it cannot buckle between pulleys because of the solid inserts filling up all of the spaces within which buckling may otherwise occur. The solid inserts furthermore supportingly engage the sides of the cable so that cable deployment may continue without buckling or jamming. Such inserts are shaped for disposition adjacent to each other in free-floating positions projecting into the spaces between cable pulleys, instead of being fixed or bolted in place to also allow easy removal and replacement of parts of the assembly during overhaul, including the cable pulleys through which the selectively controlled movement is imparted to the antenna cable.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 1 is a perspective view of an antenna transfer assembly with which the present invention is associated, adapted to be mounted on a submarine hull;

FIG. 2 is a side elevation view of the antenna transfer assembly illustrated in FIG. 1;

FIG. 3 is an enlarged partial section view taken substantially through a plane indicated by section line 3—3 in FIG. 2, showing disposition of a cable and jam preventing inserts within the antenna transfer assembly;

FIG. 3A is a partial section view, corresponding to that of FIG. 3 without the inserts, and showing the cable jammed in a buckled condition;

DETAILED DESCRIPTION OF PREFERRED EMBODIMENT

Figure 4:
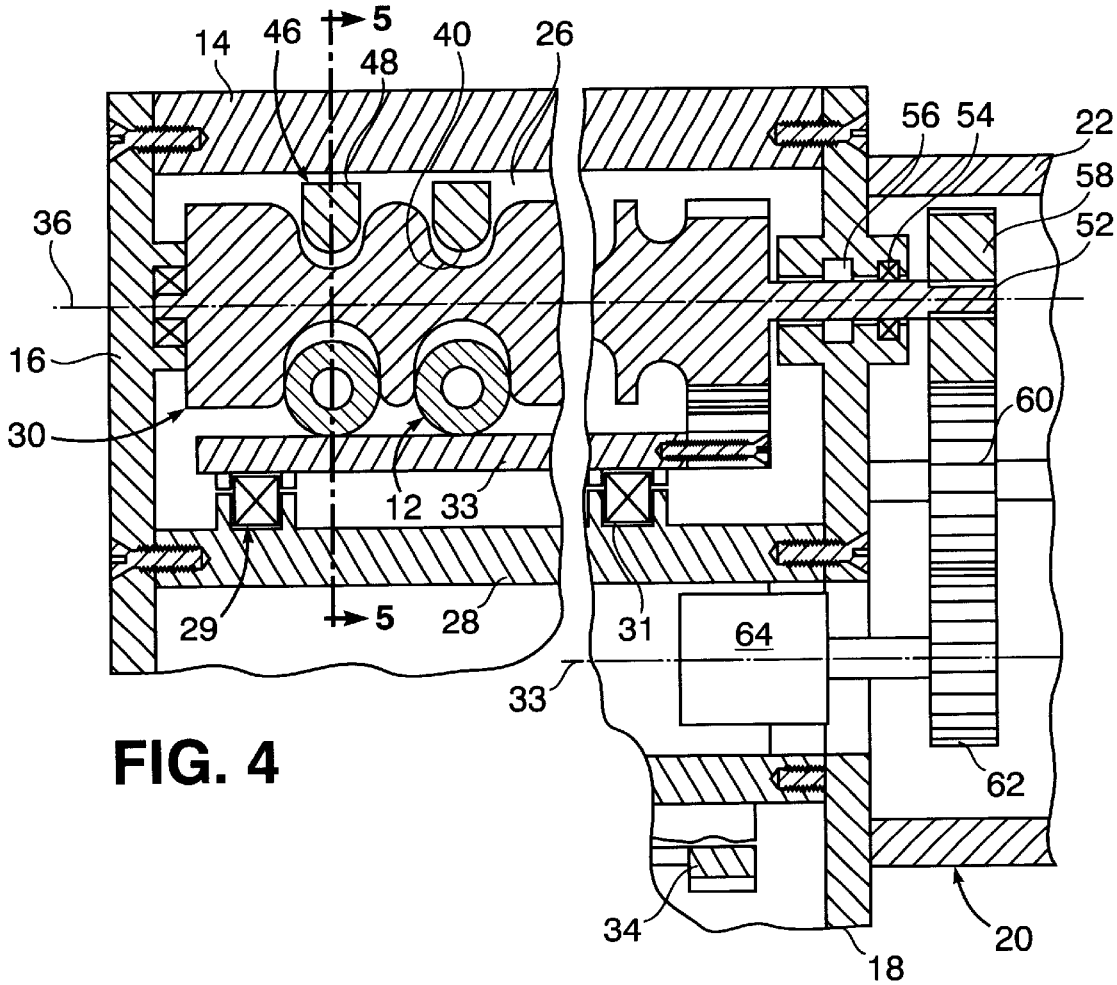
FIG. 4 is a partial section view taken substantially through a plane indicated by section line 4—4 in FIG. 3.

Referring now to the drawing in detail, FIGS. 1 and 2 illustrate an antenna transfer assembly, generally referred to by reference numeral 10 involving deployment and retrieval of a flexible and buoyant antenna cable 12, and having an outer cylindrical wall 14 forming a housing closed at its axial ends by end plates 16 and 18. Extending axially from and attached to the end plate 18 of the housing, is a powered drive assembly 20 enclosed by an outer cylindrical wall 22 of smaller diameter than that of the housing wall 14. Inlet and outlet guides 23 and 24 are respectively connected to and project tangentially from the cylindrical housing wall 14 for accommodating reception and exit of the antenna cable 12 from the housing within which it is disposed in a helical wound condition as hereinafter pointed out. Such housing of the antenna transfer assembly 10 enclosed by the outer housing wall 14 between the end plates 16 and 18 is placed under high seawater pressure during transport by a submarine hull through an underwater environment.

Figure 5:
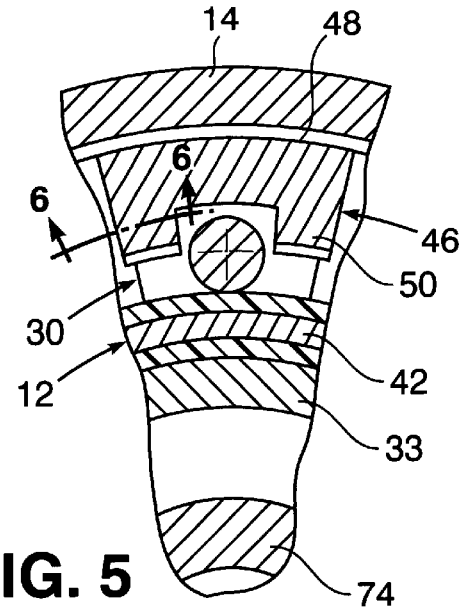
FIG. 5 is a partial section view taken substantially through a plane indicated by section line 5—5 in FIG. 4.

As shown in FIGS. 3, 4 and 5, the outer housing wall 14 forms an annular passage portion 26 of the housing enclosure formed about a radially inner housing wall 28 within which the inner housing enclosure portion is formed extending into the drive assembly 20. A pair of bearings 29 and 31 are mounted on the inner housing wall 28 adjacent opposite axial ends thereof for rotational support of a cylindrical drum 33. The antenna cable 12 is supported on the drum 33 in the aforementioned helically wound condition along a helical path established between rows of circumferentially spaced cable pulleys 30, such as 24 pulleys 30 disposed within the radially outer portion 26 of the housing enclosure. Each cable pulley 30 is rotationally journaled therein by the housing end plates 16 and 18, as shown in FIG. 4.

A gear formation 32 at one end of each cable pulley 30 is enmeshed with an annular driving gear 34 fixed to one axial end of the drum 33 through which it transfers rotation simultaneously to all of the pulleys 30 from two of the pulleys 30. The drive assembly 20 selectively imparts rotation to such two cable pulleys 30 in opposite directions about their axes 36 parallel to the central housing axis 38. Movement is thereby applied through all of the pulleys 30 to the antenna cable 12 for insertion into and retrieval from the passage portion 26 of the housing enclosure.

The two pulleys 30 driven by the drive assembly 20 have axle portions 52 extending therefrom through the end plate 18 as shown in FIG. 4 into the housing 22 of the drive assembly. In addition to rotational support of the axle 52 by a bearing 54, a seawater seal 56 is provided. The two axles 52 are respectively connected to gears 58 enmeshed with an idler gear 60 supported within the drive assembly housing 22. The idler gear 60 is in turn enmeshed with a drive gear 62 connected to a hydraulic motor 64 under selective control of the drive assembly 20, All of the cable pulleys 30 thereby simultaneously driven under control of the drive assembly 20, have axially spaced curved surface recesses 40 within which the cable 12 is received in its helically wound condition, such as five wraps about the drum 33. The cable 12 is held in frictional driving contact with each of the pulleys 30 at a plurality of axially spaced locations therealong within their recesses 40 while supported on the drum 33, is thereby maintained in its helically wound condition extending between the inlet and outlet guides 23 and 24 through the housing passage portion 26 as aforementioned. With the inserted cable 12 so held on the drum 33 by the pulleys 30, it is deployed under selective control exercised by the powered drive assembly 20.

The antenna cable 12 is pushed out of a hull by the antenna transfer assembly 10 against forces created due to friction and seawater pressure pushing inboard on the antenna tip. Occasionally during such deployment the antenna cable 12 is thereby subjected to high axial compression. Heretofore, such high axial compression caused the antenna cable 12 to buckle, as shown in FIG. 3A, so that buckled sections 12A of the cable became radially displaced from the drum 33 into the spaces between the cable pulleys 30. Such buckled sections 12A of the cable caused jamming which then prevented deployment or retrieval of the cable 12. Buckling of the cable 12 occurred because of the flexibility property of its construction involving an inner cable wire 42 covered by an outer insulation covering 44 as shown in FIGS. 3, 3A and 5.

Figure 6:
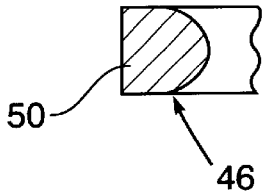
FIG. 6 is a section view of one of the jam preventing inserts disposed in the antenna transfer assembly taken substantially through a plane indicated by section line 6—6 in FIG. 5.

In accordance with the present invention, jamming of the antenna cable 12 by buckling thereof as depicted in FIG. 3A, is prevented by use of free-floating inserts 46 respectively aligned with each of the pulleys 30, to substantially fill the spaces therebetween and between the pulleys 30 and the outer wall 14 within the radially outer portion 26 of the housing passage enclosure as depicted in FIGS. 3, 4 and 5. Each of such inserts 46, as shown in FIGS. 5 and 6, includes an outer curved surface portion 48 from which spaced leg portions 50 extend. The outer insert surface portions 48 almost abut and match the cylindrical inner surface of the stationery outer housing wall 14. The spaced leg portions 50 of the inserts 46 substantially occupy the circumferential spacings between the recess portions 40 of adjacent pulleys 30, into which the leg portions 50 of adjacent inserts 46 extend from their outer surface portions 48 which match the closely spaced cylindrical surface of the outer assembly wall 14. Thus, antenna jamming is avoided by substantially filing otherwise seawater filled spaces with the appropriately shaped inserts 46, made of solid material and free-floatingly disposed to allow individual insertion and removal of the pulleys 30, even though they may be occasionally touching the moving surface on the pulleys 30 and/or the internal stationery surface on outer housing wall 14.

Obviously, other modifications and variations of the present invention may be possible in light of the foregoing teachings. It is therefore to be understood that within the scope of the appended claims the invention may be practiced otherwise than as specifically described.

What is claimed is:

1. In combination with an assembly having a passage formed therein between internal surfaces, a flexible antenna cable deployed or retrieved under selective drive control and a plurality of cable pulleys spaced from each other within said passage through which said drive control is exercised on the cable; the improvement residing in means for preventing jamming of the cable by buckling thereof between the pulleys, comprising: a plurality of solid inserts floatingly disposed within said passage respectively in aligned relation to the pulleys to substantially fill the passage not occupied by the pulleys; said inserts being shaped in relation to the internal surfaces and the pulleys to block said buckling of the cable.

2. The combination as defined in claim 1, wherein each of said cable pulleys has axially spaced recesses formed therein within which the inserts are respectively received in said aligned relation, closely spaced from one of the internal surfaces between which the passage is formed.

3. The combination as defined in claim 2, wherein the shaped inserts have outer surfaces matching said one of the internal surfaces of the assembly.

4. The combination as defined in claim 3, wherein said internal surfaces between which the passage is formed are cylindrical.

5. The combination as defined in claim 4, wherein the outer surfaces of the inserts are curved to match in shape said one of the cylindrical surfaces formed on an outer wall of the assembly.

6. The combination as defined in claim 1, wherein the shaped inserts have outer surfaces matching one of the internal surfaces of the assembly between which the passage is formed.

7. The combination as defined in claim 1, wherein said internal surfaces between which the passage is formed are cylindrical.

* * * * *